United States Patent [19]

Widén

[11] Patent Number: 4,815,307

[45] **Date of Patent: * Mar. 28, 1989**

[54] KEY BLADE AND METHOD OF PRODUCING SAME

[75] Inventor: Bo Widén, Torshälla, Sweden

[73] Assignee: Widén Innovation AB, Torshälla, Sweden

[ * ] Notice: The portion of the term of this patent subsequent to Jul. 12, 2005 has been disclaimed.

[21] Appl. No.: 6,437

[22] Filed: Jan. 23, 1987

[30] Foreign Application Priority Data

Jan. 31, 1986 [SE] Sweden ..... 86004/45

[51] Int. Cl.[4] ..... E05B 27/10

[52] U.S. Cl. ..... 70/493; 70/378; 70/392; 70/407; 70/409; 70/421

[58] Field of Search ..... 70/358, 364 A, 363, 70/378, 392, 406–409, 419–421, 362, 365, 366, 376, 377

[56] References Cited

U.S. PATENT DOCUMENTS

| | | | |
|---|---|---|---|
| Re. 30,198 | 1/1980 | Oliver et al. | 70/364 A |
| D. 274,302 | 6/1984 | Widen | D8/347 |
| 758,026 | 4/1904 | Taylor . | |
| 2,023,847 | 12/1935 | Liss | 70/378 |
| 2,039,126 | 4/1936 | Svoboda . | |
| 3,035,433 | 5/1962 | Testa | 70/364 |
| 3,499,302 | 3/1970 | Spain et al. . | |
| 3,722,240 | 3/1973 | Spain et al. | 70/364 A |
| 4,111,021 | 9/1978 | Roberts | 70/406 |
| 4,356,713 | 11/1982 | Widen | 70/364 A |
| 4,393,673 | 7/1983 | Widen | 70/358 |
| 4,434,636 | 3/1984 | Prunbauer | 70/364 A |
| 4,453,432 | 6/1984 | Widen | 76/110 |
| 4,507,944 | 4/1985 | Widen et al. | 70/276 |
| 4,723,427 | 2/1988 | Oliver | 70/362 X |

FOREIGN PATENT DOCUMENTS

| | | |
|---|---|---|
| 0008310 | 3/1980 | European Pat. Off. . |
| 0065813 | 12/1982 | European Pat. Off. . |
| 0103532 | 3/1984 | European Pat. Off. . |
| 0110647 | 6/1984 | European Pat. Off. . |
| 7203658 | 1/1979 | Fed. Rep. of Germany . |
| 241373 | 7/1946 | Switzerland . |

*Primary Examiner*—Robert L. Wolfe
*Assistant Examiner*—Suzanne L. Dino
*Attorney, Agent, or Firm*—Birch, Stewart, Kolasch & Birch

[57] ABSTRACT

A key blade having a longitudinal axis (A) of insertion and comprising an elongated, wave-like generally longitudinally extending code pattern (38) for cooperation with a row (23) of elevationally and rotationally movable locking tumblers (**23*a*–23*e*) of a rotary cylinder type lock (18). Each of the locking tumblers is provided with a transversely projecting finger which engages with the code pattern (38) when the key blade is inserted into the lock. The code pattern (38) includes a number of concavity locations (40–44**) which are displaced longitudinally and transversely so as to correspond to specific rotational and elevational positions of the locking tumblers which will permit releasing of the lock.

25 Claims, 4 Drawing Sheets

Fig. 12
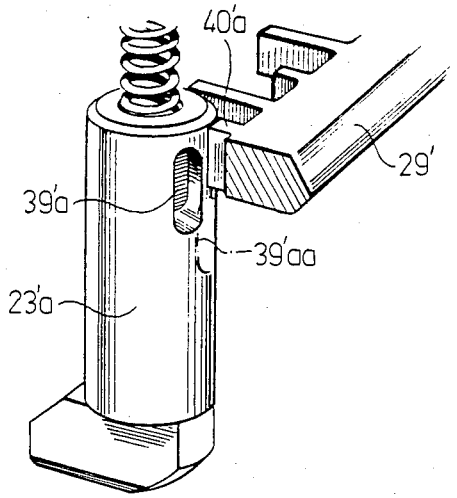
Fig. 13
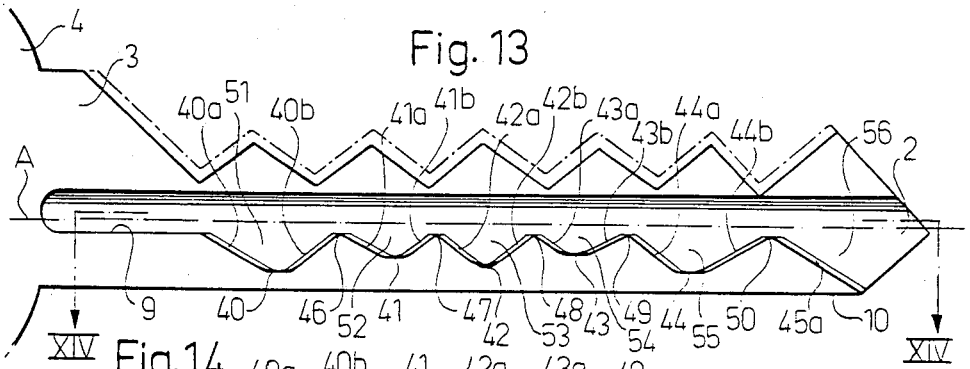
Fig. 14
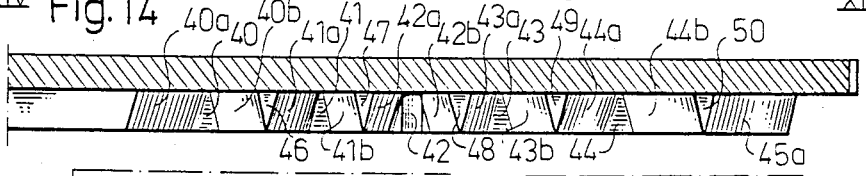
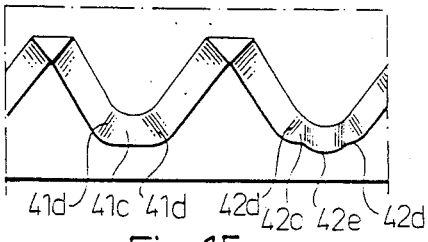
Fig. 15
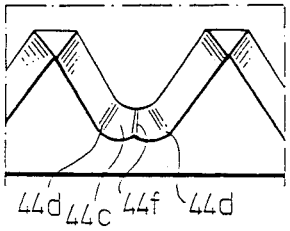
Fig. 16

KEY BLADE AND METHOD OF PRODUCING SAME

The present invention relates to a key blade having a longitudinal axis of insertion and comprising an elongated, wave-like, generally longitudinally extending code pattern for cooperation with a locking tumbler of a rotary cylinder type lock.

Such key blades are previously known from e.g. U.S. Pat. No. 2,039,126 (Svoboda) and DE-U-7203658 (Neiman). In both cases, a wave-like code pattern is formed as a groove in each generally flat side of the key blade, and each groove is adapted to positively engage, at both side walls of the groove, transversal projections extending from the tumblers into the key slot of the lock. The tumblers are constituted by plates and are guided for elevational movement in response to the positive engagement with the groove of the key blade when the latter is being inserted into the key slot.

The key blade according to U.S. Pat. No. 2,039,126 additionally includes cam surfaces at the opposite edges thereof, which cam surfaces co-operate with a separate row of tumblers in the lock.

The grooves of the key blade according to DE-U-7203658 have slightly bevelled edges (between each side wall of the groove and the respective flat side of the key) formed simultaneously with the groove in a single operation by means of a partially tapered cutter pin.

Although these two examples of prior art appear to be the most pertinent references, the key blade according to the present invention has been developed on the basis of other considerations.

Thus, the background of the invention has been a desire to develop a new lock and key combination so as to obtain a very high number of code combinations by using rotationally and elevationally movable locking tumblers or pins;

secure a very high resistance against picking methods and against making key impressions for obtaining a false key;

keep down the dimensions of the key blade while maintaining a high number of code combinations;

enable leaving major portions of the key blade free for conventional profile grooves and/or other known or yet to be developed code patterns;

making unauthorized key making or copying difficult by a unique method of forming the code pattern in the key blade.

To achieve these aims, a new lock and key combination has been developed, wherein the lock comprises a cylinder shell; a key plug rotationally mounted in the shell to provide a shear line between the shell and the plug; a key slot extending into the key plug in parallel to the rotational axis thereof for receiving a key blade; at least one locking tumbler including an elongated body portion guided in a complementary bore in the plug, the elongated body portion being capable of rotational and preferably also elevational movement relative to its longitudinal axis, the locking tumbler further including a finger which pivots about said longitudinal axis during rotation of the elongated body portion, the finger projecting transversely outwardly from the rotational axis of the elongated body portion and extending into said key slot for engagement with a key blade and therewith effecting rotational (and elevational) movement of the elongated body portion; and a fence member blockingly associated with said locking tumbler and shaped so that rotational and possibly elevational positioning of said elongated body portion upon engagement of said finger with a properly shaped key allows said fence member to clear the shear line.

The object of the present invention is to provide a key blade co-operating effectively with such a lock and contributing to achieving the various aims listed above. In particular, the code pattern of the key blade should be such as to engage smoothly with the pivotable finger or fingers and with little wear while securing that each locking tumbler is precisely positioned to release the lock.

According to a first aspect of the invention this object is fulfilled in that the code pattern comprises a one-sided guiding surface for engagement with a pivotable finger of a locking tumbler, said guiding surface including at least one concavity location, including a bottom surface portion and adjoining straight side wall portions extending obliquely with respect to the longitudinal axis of the key blade, for positioning and supporting said pivotable finger, and sloping surface portions adjoining each of said side wall portions of said concavity location, at least a part of each sloping surface portion being bevelled and oriented so as to face away from the key blade and to enable a smooth sliding contact with said pivotable finger when the key blade is being inserted into said lock.

The bottom portion and the adjoining, obliquely extending side wall portions of the concavity location will permit the pivotable finger of the locking tumbler to swing from one end position to another, in case the concavity location passes by the corresponding locking tumbler while the key blade is being inserted into the key slot. When the key blade reaches its fully inserted position, the concavity location will provide a well-defined support for the corresponding finger in a predetermined position, so that the body portion of the locking tumbler is exactly positioned to allow the fence member to clear the shear line and open the lock.

According to a second aspect of the invention, the key blade, which is to be used in combination with a lock having a row of locking tumblers each having a pivotable finger, comprises a wavelike code pattern cooperating with said fingers of said locking tumblers, said wave-like code pattern including longitudinally displaced concavity locations located so as to correspond to specific pivotal positions of said fingers upon insertion of the key blade into the key slot.

Thus, generally, the longitudinal distribution of the concavity locations in the key blade will differ from the longitudinal distribution of the locking tumbler axes. If the locking tumblers are uniformly spaced along the row, the concavity locations in the key will generally be irregularly distributed in the longitudinal direction for receiving and supporting the various fingers in different pivotal positions. Preferably, the concavity locations are displaced also in a transversal direction so as to correspond to specific elevational positions of the fingers.

According to a third aspect of the invention, the key blade has a longitudinal axis of insertion and comprises an irregular elongated generally longitudinal extending wave-like code pattern, (e.g. in a generally flat side portion of the blade, in which case the code pattern has a depth which extends only partially through the blade), the key blade being characterized in that the code pattern comprises a guiding surface including longitudinally and elevationally displaced concavity locations, at least one of the concavities having a side wall portion which is obliquely extending with respect to the longitudinal axis of the blade.

According to a fourth aspect of the invention, the code pattern formed in the key blade comprises a guiding surface including longitudinally (and possibly elevationally) displaced concavity locations, the longitudinal distribution of said concavity locations being irregular.

A key blade according to the invention can preferably be produced by forming the wave-like code pattern by means of a cutter pin, wherein, at least in the final stage of forming the code pattern, the axis of said cutter pin is positioned so as to be inclined relative to a direction normal to the plane of the key blade, said cutter pin axis inclining towards the front end of the key blade when the sloping portions facing towards the rear end are being formed and said cutter pin axis inclining towards the rear end when the sloping portions facing towards the front end are being formed.

Further features and advantages of the inventive key blade will appear below. Thus, a preferred embodiment of the key blade will now be described with reference to the appended drawings.

FIG. 12 shows in a perspective view a modified embodiment of the locking pin of FIG. 7 and a part of a modified side bar;

FIG. 13 is a side view, in a larger scale, of the key blade in FIG. 1;

FIG. 14 is a longitudinal section along line XIV—XIV in FIG. 13 illustrating a code pattern seen from above;

FIG. 15 and 16 illustrate in perspective views (obliquely from above) various portions of the code pattern in the key blade, including different kinds of concavity locations co-operating with a finger extending from the locking pin of FIGS. 7, 9 or 12.

Figure 3:
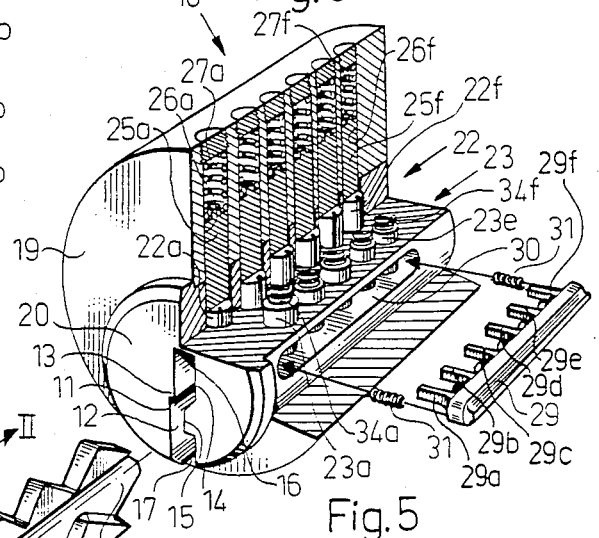
FIG. 3 illustrates a lock to be used in combination with the key blade of FIG. 1, a part of the lock being broken away to show the inside thereof.
Figure 1:
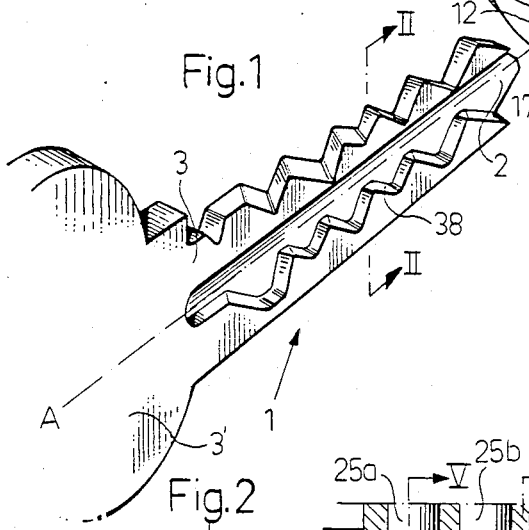
FIG. 1 illustrates a key blade according to the invention in a perspective view.

The key blade 1 shown in FIGS. 1 and 13 has a longitudinal axis A of insertion and is insertable into the lock shown in FIG. 3. The key blade 1 has a front end 2 and a rear end 3 adjoining a grip portion or bow 3' so as to form a complete key.

Figure 2:
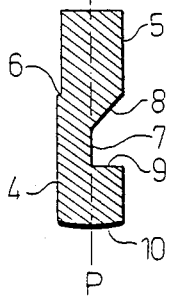
FIG. 2 is a transverse section along line II—II in FIG. 1.

As appears from FIG. 2, the key blade 1 is generally flat with substantially planar side surfaces 4 and 5. The side surface 4 to the left in FIG. 2 has a minor step 6, and the side surface 5 to the right in FIG. 2 has a longitudinal groove 7 with an upper side wall 8 inclined so as to face away from the blade 1 and a lower side wall 9 oriented substantially perpendicularly to the central plane P of the blade. Furthermore, the lower edge surface 10 is slightly curved. It will be apparent from figures 1, 2 and 3 that the key blade 1 has a cross-sectional shape fitting into the key slot 11 of the lock. Thus, the key slot 11 has a generally rectangular cross-section and is confined by a left side wall 12 with a step 13 corresponding to the step 6 of the key blade, a right side wall 14 with a longitudinal ridge 15 matching the groove 7 of the key blade, a short upper straight wall 16 and a lower, slightly curved wall 17 matching the lower edge surface 10 of the key blade.

The lock, generally denoted by numeral 18 in FIG. 3, is of the kind described in detail in applicant's copending application (filed on the same day as the present application) on a "lock and key blade." The disclosure of the copending application is included herein by reference, and in this description only the main features of the lock will be discussed.

Figure 5:
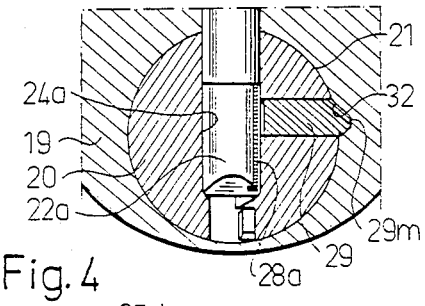
FIG. 5 is a transverse section along line V—V in FIG. 4.

The lock 18 is of the rotary cylinder type and comprises a cylinder shell 19, a key plug 20 rotationally mounted in the shell 19 to provide a shear line 21 (see FIGS. 5 and 6) between the shell 19 and the plug 20. The key slot 11 extends into the key plug 20 in parallel to the rotational axis thereof for receiving the key blade 1.

The lock 18 further includes two rows 22, 23 of locking tumblers or pins located in two mutually parallel planes. On row 22 of six locking pins 22*a*–22*f* is centrally located substantially in the central plane of the key slot 11. Each locking pin 22*a*–22*f* is guided for elevational and rotational movement in a cylindrical bore 24*a*–24*f*, respectively, in the key plug 20, each such bore communicating with the upper part of the key slot 11, so that the lower chisel end portion of each lockig pin 22*a*–22*f* can engage with the V-shaped, skew cuts at the upper edge portion of the key blade 1 upon insertion of the key. A corresponding row 25 of upper driving pins 25*a*–25*f* are reciprocally guided in cylindrical bores 26*a*–26*f* in the cylinder shell 19 and are urged downwards by driving springs 27*a*–27*f* so as to effect a downwardly directed force on each locking pin 22*a*–22*f* (in the rotary position of the key plug 20 shown in FIG. 3, where the bores 24*a*–24*f* and 26*a*–26*f* register) or on the outer cylindrical surface of the key plug 20 (upon release and rotation thereof).

Figure 10:
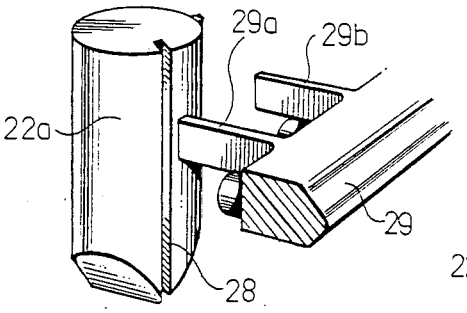
FIG. 10 is a perspective view, likewise in a larger scale, of another kind of locking pin included in the lock in FIG. 3 and a part of the side bar shown also in FIGS. 7 and 9.
Figure 11:
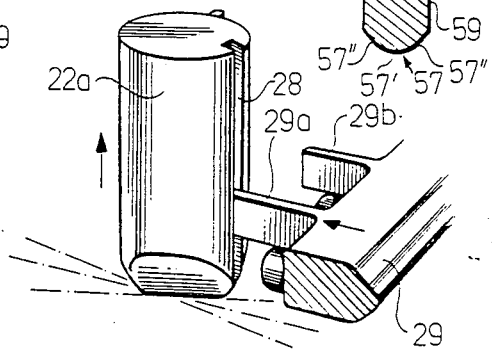
FIG. 11 is a perspective view similar to FIG. 10, wherein the locking pin registers with the side bar.

To clear the shear line 21 between the shell 19 and the plug 20, a key blade with a properly cut upper edge has to be inserted into the key slot, so that each locking pin 22*a*–22*f* is elevated into a position where the upper end surface thereof coincides with the shear line 21. Moreover, each locking pin 22*a*–22*f* must be rotated (by means of the skew cuts on the upper edge of the key blade) so that a longitudinal notch 28a–28f, respectively, in the cylindrial surface thereof is positioned to register (see FIGS. 10 and 11) with a (relatively long) lug 29a–29f, respectively, of a fence member or side bar 29, which is slidably engaged in a laterally opening slot 30 in the key plug 20. The side bar 29 is urged by springs 31 to a blocking position (see FIG. 5) in which a radially outwardly projecting cam portion 29m engages a corresponding cam groove 32 in the internal cylindrical surface of the shell 19. However, when all lugs 29a–29f register with the notches 28a–28f of the locking pins 22a–22f, the side bar is permitted to yield inwards against the action of the springs 31, when a rotary torque is applied between the plug 20 and the shell 19, whereupon the plug 20 can be rotated.

The locking mechanism described so far is previously known from e.g. U.S. Pat. No. 3,499,302 (and U.S. Pat. No. Re. 30,198—Oliver et al.). However, the lock 18 also comprises a further locking mechanism including the above-mentioned row 23 of locking tumblers or pins.

Figure 4:
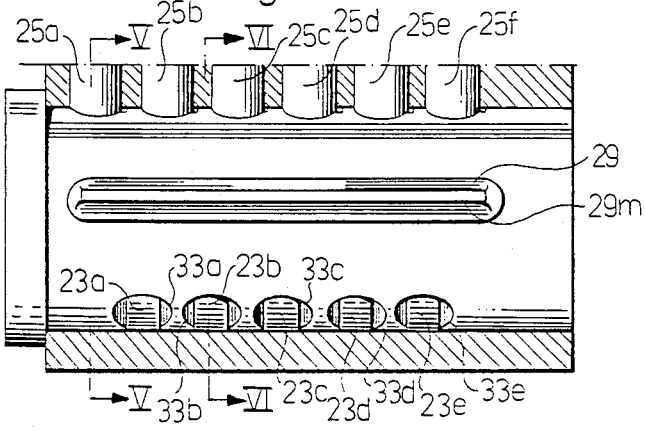
FIG. 4 is a side view of a key plug of the lock in FIG. 3.

This row of five locking tumblers or pins 23a–23e is laterally offset (to the right in FIGS. 3 and 6) but parallel to the row 22. Each locking pin 23a–23e is totally confined within the key plug 20 in a corresponding, preferably cylindrical cavity or bore 33a–33e, respectively (see also FIGS. 4 and 6).

Figure 6:
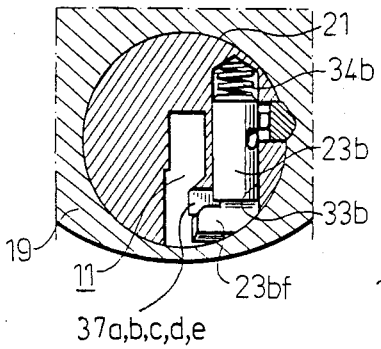
FIG. 6 is a transverse section along line VI—VI in FIG. 4.
Figure 7:
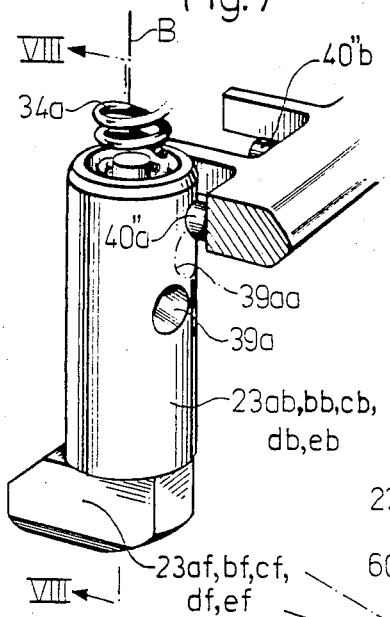
FIG. 7 is a perspective view, in a larger scale, of a locking pin and a part of a side bar forming parts of the lock in FIG. 3.
Figure 9:
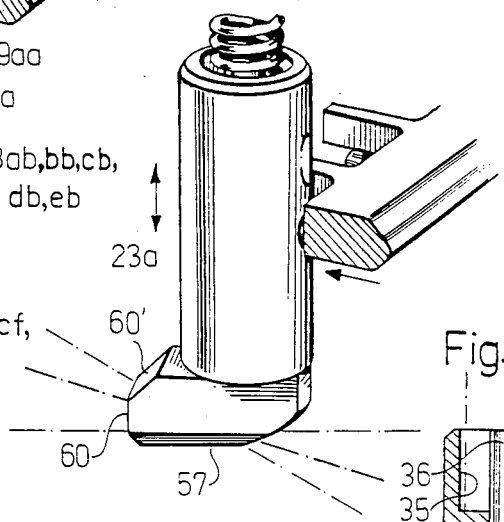
FIG. 9 is a perspective view similar to FIG. 7, wherein the locking tumbler or pin is positioned to register with the side bar.
Figure 8:
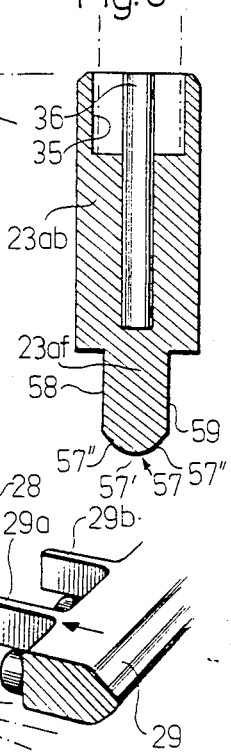
FIG. 8 is a longitudinal section along line VIII—VIII in FIG. 7.

Each locking pin 23a–23e is urged downwardly (as seen in the drawing figures) by spring 34a–34e, respectively, acting between the bottom end of each bore 33a–33e, and the top of each locking pin 23a–23e. As shown in FIGS. 7, 8 and 9, the spring is partially accommodated and guided in an upper recess formed by a bore 35 (FIG. 8) and surrounds a central pin member 36 serving as drill protection. The respective locking pin 23a–23e comprises a cylindrical body portion 23ab–23eb, permitting rotational and elevational movement in the respective bore and a finger 23af–23ef, respectively, projecting transversely from the lower end of the body portion through corresponding openings 37a–37e in the key plug wall between the respective bore 33a–33e and the key slot 11. Thus, as seen in FIG. 6, the finger (23bf) extends partially into the key slot 11 adjacent to the ridge 15.

As will be explained further below, the engagement between the key blade 1 and the fingers 23af–23ef will cause each finger to pivot about the longitudinal axis B (FIG. 7) of the cylindrical body portion 23ab–23eb, respectively, and to be displaced upwardly and downwardly while contacting an elongated, wave-like code pattern 38 formed in the lower side wall 9 of the key blade groove 7. When the finger pivots and reciprocates, the corresponding cylinder body portion 23ab–23eb of the locking pin 23a–23e will perform a rotational and elevational movement. The corresponding spring 34a–34f urges the locking pin 23a–23e downwardly so as to secure a continuous contact between the finger 23a–23e and the code pattern 38 when the key blade 1 is being inserted into the key slot 11.

To permit such pivoting and reciprocating of the fingers 23a–23e the openings 37a–37e between the bores 33a–33e and the key slot 11 have greater vertical extension than the height of the finger (in a direction parallel to the longitudinal axis B in FIG. 7) and are wide enough to permit pivoting about 15° (in this particular embodiment) in each direction from a direction normal to the longitudinal axis of the key slot 11, preferably with side walls inclined so as to face the key slot 11 and to provide a well defined supporting abutment in each pivotal end position of the respective finger. These side walls also permit a smooth sliding engagement when the finger is being reciprocated upwardly and downwardly.

As appears from FIGS. 7, 9 and 12 the cylindrical body portion 23ab–23eb of each locking pin has at least one coded recess 39 in the cylindrical mantle surface, said coded recess being dimensioned to receive a corresponding one of a set of relatively short lugs 40''a (FIG. 7) projecting from the side bar 29 between the longer lugs 29a–29f (FIG. 11) mentioned above.

In FIGS. 7 and 9, the coded recess is constituted by a cylindrical bore 39a, whereas the corresponding lug is a cylindrical pin 40''a fitting into the bore 39a. When the locking pins 23a–23e are positioned in predetermined elevational and rotational positions, the cylindrical pins 40''a, etc. will register with the cylindrical bores 39a–39e and permit the side bar to be displaced transversely into its inward, seated position in the slot 30 of the key plug 20, thus releasing the lock (provided that the longer lugs 29a–29f also register with the notches 28a–28f of the locking pins 22a–22f).

In FIG. 12 there is shown a modified embodiment, wherein the recess in the cylindrical surface of the locking pin 23'a is constituted by an elongated slot 39'a, whereas the corresponding short lug of the side bar 29' is constituted by a short bar 40'a (having a generally rectangular cross-section matching the shape of the elongated slot 39'a). In any case, the recess and the lug should be so designed that the locking pin is kept in a well-defined elevational and rotational position when the lug is fitted into the recess.

To provide a master key system, each locking pin may have at least one further recess 39aa, 39'aa, as indicated by dash-dotted lines in FIGS. 7, 9 and 12.

Now, the code pattern 38 in the key blade 1 will be described with reference to FIGS. 1, 2, 13, 14, 15, 16, 17 and 18.

Figure 17:
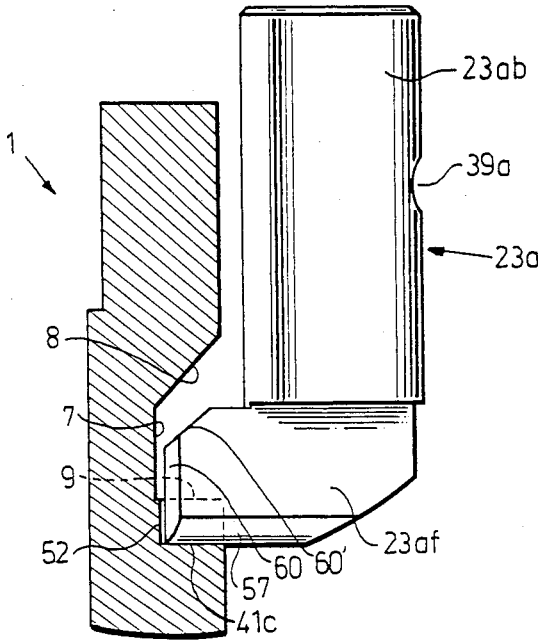
FIG. 17 shows (in a larger scale) the key blade in cross-section and a locking pin with a finger engaging a concavity location.
Figure 18:
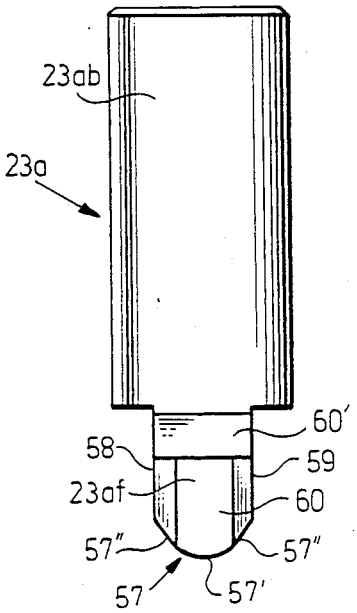
FIG. 18 shows (likewise in a larger scale) a side view of a locking pin and its finger (seen from its free end).

The groove 7 extending along the longitudinal axis A of the key blade 1 from the rear end 3 to the front end 2 has a depth corresponding to approximately half of the thickness of the blade, as will be seen from FIGS. 2 and 17. The depth is such that the free end of each finger 23af–23ef will always be located at some distance from the bottom wall of the groove. In any case, the bottom wall of the groove 7 does not interfere with the pivoting movement of the fingers. Instead, the pivoting and reciprocating of the fingers will solely be caused by the engagement, secured by the action of the springs 34a–e, between the lower portion of the fingers and the code pattern 38 formed in the lower side wall 9 of the groove (see FIG. 17). Thus, the upper, unbroken, inclined side wall 8 of the groove does not either engage with the fingers.

The code pattern 38 is consequently constituted by a one-sided, wave-like guiding surface including a number of concavity locations 40, 41, 42, 43, 44 and adjoining sloping surface portions 40a, 40b, 41a, 41b, 42a, 42b, 43a, 43b, 44a, 44b extending between each concavity location and the remaining portions of the groove side wall 9 so as to leave substantially planar top surface portions 46, 47, 48, 49 and 50 between each pair of adjacent sloping surface portions, there being a further sloping surface portion 45a reaching all the way to the lower edge 10 of the key blade adjacent to the front end 2 thereof so as to provide an inlet guiding surface permitting each finger 23af–23ef to enter into engagement with the wave-like code pattern when the key blade 1 is being inserted into the key slot 11.

The recesses formed in the lower side wall 9 of the groove 7 to provide the code pattern 38 have substantially the same depth as the groove 7 itself (see FIG. 17). Thus, the inside portions 51, 52, 53, 54, 55, 56 of these recesses form planar extensions of the bottom wall of the groove 7 and do not interfere with the fingers 23a-f–23ef.

Each concavity location 40, 41, 42, 43, 44 has a bottom surface portion (41c, 42c and 44c in FIGS. 15 and 16), which is generally triangular and oriented so as to face upwardly and which extends substantially normal to the central plane P of the blade (see FIGS. 2 and 17) and in parallel to the longitudinal axis A of the blade (see FIG. 13). The triangular configuration of the bottom surface portions is such as to provide a well-defined support of the respective finger, both in the process of inserting the key blade, in which case the finger will swing from one pivotal end position to the other while the respective concavity location of the blade passes by the location of one of the locking pins 23a–23e of the lock, and when reaching the fully inserted position of the key blade in the key slot, in which case the fingers will be directed in various predetermined pivotal positions, e.g. in a straight transverse position or in a pivotal end position where the finger is directed obliquely towards the front or rear end of the key blade (compare the three dash-dotted lines in FIG. 9).

To provide such a support the generally triangular bottom surface portion, as denoted by reference numerals 41c, 42c, and 44c, respectively in FIGS. 15 and 16, has adjoining straight side wall portions 41d, 42d and 44d, respectively, these side wall portions extending obliquely with respect to the longitudinal axis A of the key blade (and with respect to a direction normal to the central plane P of the key blade).

The triangular configuration of the bottom surface portions is such that one side of the triangle is located adjacent to the side surface 5 of the key blade 1 (see FIG. 2), whereas the corner opposite to said one side of the triangle is located adjacent to the inside portion 51,52,53,54 or 55 of the corresponding recess. Generally, the triangle can be truncated at the inside so that the bottom surface is confined within four sides, namely a longer outward side, a shorter inward side (parallel to the outward side) and two sides converging towards each other inwardly.

Preferably, the bottom surface portion 41c, 42c, 44c merges smoothly with the adjoining side wall portions 41d–44d with a curvature corresponding essentially to a lower convexly curved, e.g. cylindrical surface portion 57 of the respective finger. Also, the oblique direction of each side wall portion 41d–44d should correspond essentially to the end position pivotal direction of the finger so as to provide a linear or surface contact between the finger and the respective side wall portion.

As illustrated in FIG. 15 (to the right), at least one of the bottom surface portions (42c) may be provided with a part cylindrical recess 42e, the cylinder axis of which recess extends perpendicularly to the longitudinal axis A of the key blade so as to provide a well-defined support of a finger in a corresponding straight transverse position.

It is also possible, to facilitate the manufacture by means of a cutter pin, to leave a shallow, central, transverse ridge 44f in the middle of the bottom surface portion 44c, as illustrated in FIG. 16.

The sloping surface portions 40a,b, 41a,b, 42a,b, 43a,b, 44a,b adjoining the side wall portions 41d–44d, as well as the inlet sloping surface portion 45a are generally parallel to the oblique direction of the side wall portions 41d–44d and thus form bevel surfaces facing away from the key blade. In this way, the lower curved portions 57 of the fingers will engage the sloping surface portions with a linear contact so as to reduce the wear of the mutually contacting surfaces when the fingers slide along these sloping surface portions of the wave-like code pattern. To provide such a linear contact, it is sufficient that only an outer part of the sloping surface portions is bevelled. Moreover, such a partial bevel may be extended over the concavity locations, since the inner parts of the bottom and side wall portions thereof will provide sufficient support.

The dimensions of the concavity locations are adapted to match the geometric shape and dimensions of the fingers so as to provide an effective positioning and support of the fingers in their predetermined pivotal positions.

Generally, the longitudinal distribution of the concavity locations 40–44 differs from that of the row 23 of locking pins 23a–23e, so that the fingers 23af–23ef are positioned in different pivotal directions in the fully inserted position of the key blade 1. As appears from FIG. 13, the concavity locations 40–44 are displaced also in a transverse or vertical direction (parallel to the central plane P of the key blade). Therefore, the code pattern 38 of the key blade 1 will effect a coded elevational and rotational positioning of each locking tumbler or pin 23a–23e.

Suppose that three different pivotal positions and three different elevational positions are possible for each of the five locking pins. Then, the number of useable combinations provided by the code pattern 38 will be $(3\times3)^5=59049$. Of course, if the key blade includes a further code pattern, e.g. skew cuts at the upper edge of the blade, as indicated in FIGS. 1 and 13, the total number of combinations will be the product of the two combination numbers.

However, in various applications, the number of concavity locations (and locking pins in the lock) may be greater or lower, and even a single concavity location cooperating with a single locking tumbler or pin is conceivable.

Likewise, the number of different pivotal positions, i.e. the number of possible longitudinal displacements of each concavity location, may be increased if the supporting bottom surface portions are provided with a corresponding number of angularly displaced support portions (such as the part cylindrical recess 42e in FIG. 15, though oriented at various angles). Of course, the number of different elevational positions, i.e. the number of possible transverse displacements of each concavity location, may also be varied at will.

The code pattern 38 can be produced in many ways, in particular by means of cutter pins. The major outline of the groove 7 and the adjoining recesses 51–56 can be made by the conventional use of cutter pins, e.g. in a numerically controlled machine. Then, the bevelled surface portions 40a,b–45a are formed by a cylindrical cutter pin being positioned so as to be inclined relative to a direction normal to the plane P of the key blade. Thus, when the sloping portions 40b,41b,42b,43b,44b facing towards the rear end 3 of the key blade are being formed, the cutter pin axis is inclined towards the front end 2 of the key blade, whereas, when the sloping portions 40a,41a,42a,43a,44a facing towards the front end 2 of the key blade are being formed, the cutter pin axis is inclined towards the rear end 3 of the key blade. Preferably, the cutter pin axis should always be maintained parallel to a plane, which extends through the longitudinal axis A normal to the plane P of the key blade, i.e. the cutter pin axis should not be inclined downwards or upwards (if the key blade is placed in an upright position). In this way, the side wall portions 41d–44d of the concavity locations can be formed simultaneously.

It is possible to form all sloping portions 40a,41a,42a,43a,44a,45a, or 40b,41b,42b,43b,44b facing generally in one longitudinal direction in a first step and thereafter, upon changing the inclinational direction of the cutter pin, to form all sloping portions facing generally in the other longitudinal direction in a second step. By using such a method, concavity locations like 44, i.e. having a central ridge 44f, are obtained.

Alternatively, all sloping portions 40a,b–45a can be formed consecutively in a single operation. Then, the cutter pin axis is turned from one inclinational angle to an opposite inclinational angle at each concavity location 40–44 and at each top surface portion 46–50. In this case, concavity locations having a substantially planar (and horizontal) bottom surface portion, such as 41c in FIG. 15 (see also FIG. 17), will be obtained.

Additional forming of some or all of the concavity location can be achieved in a separate step by means of the cutter pin (or another cutter pin) e.g. to make a bottom surface portion, such as 44f, smooth or planar or to form a support recess, such as the part cylindrical recess 42e in FIG. 15. If only three different, predetermined pivotal positions of the fingers are used, such part cylindrical recesses 42e are preferably made only in those concavity locations which correspond to a finger directed perpendicularly to the key blade upon insertion of the key blade into the key slot.

The key blade and the code pattern thereof can be modified within the scope of the appended claims. For example, the code pattern 38 can be located at various parts of the key blade. Although the location at a side wall of a groove, as illustrated, is advantageous from the point of view of keeping down the dimensions of the key blade and also to make it especially difficult to copy a specific code pattern, the code pattern may be located on a step on the side of the blade or even at the upper or lower edge thereof. Of course, a second code pattern of the same kind as the pattern 38 may be provided at the opposite side of the blade, e.g. also in the side wall of a groove. Moreover, the sloping surface portions (40a,b–45a) may have different sloping angles. Also, the top surface portions (46–50) do not have to be located at the same level, although such an arrangmenet is convenient from a manufacturing point of view. Finally, the bottom surface portion (41c) may be inclined relative to a direction perpendicular to the key blade plane (P, FIG. 2) if the lower surface portion (57, FIG. 9) of the tumbler finger is likewise inclined correspondingly (or if the axis of the tumblers are inclined relative to the key blade plane (P)).

I claim:

1. A key blade (1) having a longitudinal axis (A) of insertion and comprising an elongated, wave-like, generally longitudinally extending code pattern (38) for co-operation with a locking tumbler (23a–23e) of a rotary cylinder type lock (18), characterized in that said code pattern comprises a one-sided guiding surface for engagement with a pivotable finger (23af–23ef) of said locking tumbler, said guiding surface including at least one concavity location (40–44), including a bottom surface portion (41c) and adjoining straight side wall portions (41d) extending obliquely with respect to the longitudinal axis (A) of the key blade, for positioning and supporting said pivotable finger, and sloping surface portions (40a,b–44a,b) adjoining each of said side wall portions (40d–44d) of said concavity location, at least a part of each sloping surface portion being bevelled and oriented so as to face away from the key blade and to enable a smooth, sliding contact with said pivotable finger when the key blade is being inserted into said lock.

2. A key blade as defined in claim 1, wherein said lock (18) comprises a row of locking tumblers (23a–23e) each having a pivotable finger (23af–23ef), characterized in that said concavity locations (40–44) are displaced longitudinally so as to correspond to specific pivotal positions of said fingers (23af–23ef) upon insertion of said key blade (1) into said lock (18).

3. A key blade as defined in claim 2, characterized in that said concavity locations (40–44) are displaced also in a transversal direction so as to correspond to specific elevational positions of said fingers (23af–23ef) upon insertion of said key blade (1) into said lock (18).

4. A key blade as defined in claim 1, characterized in that said code pattern (38) is located on at least one side portion (5) of said key blade.

5. A key blade as defined in claim 4, characterized in that at least one side (5) of said key blade comprises a longitudinal groove (7) having two side walls (8,9), said code pattern being (38) formed in one of said side walls (9).

6. A key blade as defined in claim 1, characterized in that said bottom surface of each concavity location comprises at least one support surface portion (41c,42c,44c) providing a linear or surface contact with a respective finger upon insertion of said key into said lock.

7. A key blade as defined in claim 6, characterized in that said support surface (41c) is substantially planar.

8. A key blade as defined in claim 6, characterized in that said support surface portion (41c,42c,44c) has a substantially triangular configuration with one side of the triangle facing away from the key blade and the other two sides of the triangle being parallel to and adjoining said obliquely extending side wall portions (41d,42d,44d).

9. A key blade as defined in claim 6, characterized in that said at least one support surface portion (42e) forms a part of a cylindrical surface.

10. A key blade as defined in claim 9, characterized in that a generating line of said cylindrical surface (42e) extends in a direction corresponding to the particular pivotal direction of a corresponding finger upon insertion of said key blade into said lock.

11. A key blade as defined in claim 1, characterized in that said side wall portions (41d) adjoins the respective sloping portions (40a,b–44a,b) smoothly.

12. A key blade as defined in claim 2, characterized in that said wave-like code pattern (38) comprises generally flat top portions (46–49) located between each successive pair of said concavity locations (40–44).

13. A key blade as defined in claim 1, characterized in that the key blade comprises a further code pattern including a plurality of generally V-shaped cuts across the longitudinal axis (A) of the key blade, which V-shaped cuts do not intersect with said wave-like code pattern (FIG. 1).

14. A method of producing a key blade as defined in claim 1, extending in a longitudinal direction from a rear end (3) to a front end (2) of the key blade, characterized in that a wave-like code pattern is formed by a cutter pin according to the following steps, at least in the final stage of forming the code pattern:

positioning an axis of the cutter pin to be inclined relative to a direction normal to a plane (P) of said key blade towards the front end (2) of the key blade when the sloping surface portions facing towards the rear end (3) are being formed; and positioning the axis of the cutter pin to be inclined relative to the direction normal to a plane (P) of said key blade towards the rear end (3) of the key blade when the sloping surface portions facing towards the front end (2) are being formed.

15. A method as defined in claim 14, characterized in that all the sloping surface portions (e.g. **40*b*–44*b*) facing in one longitudinal direction of the key blade are formed in a first step and all the sloping surface portions (e.g. 40*a*–44*a***) facing in the other longitudinal direction of the key blade are formed in a second step.

16. A method as defined in claim 14, characterized in that all of said sloping surface portions (**40*a,b*–44*a,b***) are formed consecutively, wherein the cutter pin axis is turned from one inclinational angle to an opposite inclinational angle at each top and bottom surface portion of said wave-like code pattern.

17. A method as defined in claim 14, characterized in that at least one support surface portion (**42*c*) is formed in said at least one concavity location (42**) in a separate step.

18. A method as defined in claim 17, characterized in that one support surface portion (**42*e*) is formed in a separate step in those concavity locations (42**) only which correspond to a finger directed perpendicularly to said key blade upon insertion of said key into said lock.

19. A method as claim 18, characterized in that said one support surface portion (**42*e***) forms a part of a cylindrical surface.

20. A key blade having a longitudinal axis of insertion, the key blade having an elongated generally longitudinally extending wave-like code pattern (38) for cooperation with elevationally and rotatably movable locking tumblers (**23*a*–23*e*) of a cylinder type lock (18), characterized in that the code pattern (38) comprises a one-sided guiding surface including longitudinally displaced concavity locations (40–44) for engagement with a pivotable finger (23*af*–23*ef*) extending transversely from each of said locking tumblers, at least one of the concavity locations having a side wall portion (41*d***) which is obliquely extending with respect to the longitudinal axis (A) of the blade.

21. A key blade as defined in claim 20, characterized in that said code pattern (38) is formed in a generally flat side portion (5) of the blade, which code pattern has a depth which extends only partially through the blade.

22. A key blade as defined in claim 21, characterized in that said guiding surface is formed in a side wall (9) of an elongated generally longitudinally extending groove (7) in said side portion (5) of the blade.

23. A key blade as defined in claim 21, characterized in that the key blade further includes a plurality of generally V-shaped cuts across the longitudinal axis (A) of the key blade, which V-shaped cuts do not intersect with said wave-like code pattern.

24. A key blade having a longitudinal axis of insertion, the key blade having an elongated generally longitudinally extending wave-like code pattern (38) for cooperation with elevationally and rotatably movable locking tumblers (**23*a*–23*e*) of a cylinder type lock (18), characterized in that the code pattern comprises a one-sided guiding surface including longitudinally displaced concavity locations (40–44) for engagement with a pivotable finger (23*af*–23*ef*) extending transversely from each of said locking tumblers, the longitudinal distribution of said concavity locations being irregular so as to effect a specific rotational positioning of each locking tumbler (23*a*–23*e***) with its finger upon inserting the key blade into the lock.

25. A key blade as defined in claim 24, characterized in that said concavity locations (40–44) are displaced also in a transverse direction so as to effect a specific elevational positioning of each locking tumbler upon inserting the key blade into the lock.

* * * * *

UNITED STATES PATENT AND TRADEMARK OFFICE

CERTIFICATE OF CORRECTION

PATENT NO. : 4,815,307
DATED : March 28, 1989
INVENTOR(S) : Bo Widen

It is certified that error appears in the above-identified patent and that said Letters Patent is hereby corrected as shown below:

Title page,
Item [*] Notice, please change the date from "Jul. 12, 2005" to -- Jan. 23, 2007 --.

Signed and Sealed this

Fifth Day of August, 2003

JAMES E. ROGAN
*Director of the United States Patent and Trademark Office*